United States Patent [19]

Spademan

[11] 4,270,770

[45] Jun. 2, 1981

[54] STEP-IN SKI BINDING

[76] Inventor: Richard G. Spademan, Box 6410, Incline Village, Nev. 89450

[21] Appl. No.: 967,226

[22] Filed: Dec. 7, 1978

[51] Int. Cl.[3] ..... A63C 9/08

[52] U.S. Cl. ..... 280/624

[58] Field of Search ..... 280/611, 623, 624, 625

[56] References Cited

U.S. PATENT DOCUMENTS

| | | | |
|---|---|---|---|
| 3,606,370 | 9/1977 | Spademan | 280/624 |
| 3,797,841 | 3/1974 | McAusland | 280/624 |
| 3,884,492 | 5/1975 | Spademan | 280/624 |
| 3,905,613 | 9/1975 | Romeo | 280/623 |
| 4,063,752 | 12/1977 | Whitaker et al. | 280/624 |

*Primary Examiner*—Robert J. Spar
*Assistant Examiner*—Fred A. Silverberg
*Attorney, Agent, or Firm*—Warren M. Becker

[57] ABSTRACT

A ski binding, including a housing (10) in which there is mounted a movable clamping member (11,12) having an open position for receiving a clamp-receiving member (3) and a closed position for clamping the clamp-receiving member and a movable step-in member (40) mounted in said housing (10) having a part (41) thereof extendable beyond the surface of the housing (10) for opening and thereafter closing the clamping member (11,12) as the extendable part (41) of the movable step-in member (40) is pressed toward the housing (10). In one embodiment, the movable step-in member (41) slidably engages a facing surface (60) on a part of the clamping member (11,12) during the opening and closing of the clamping member (11,12). In another embodiment, a movable bearing member (70,80) is provided between the step-in member (40) and the clamping member (11,12) for reducing friction when the step-in member (41) is moved relative thereto; and in a third embodiment, the movable clamping member (11,12) and the clamp-receiving member (3) are provided with a groove (70) for reducing the distance the movable clamping member (11,12) is required to open to receive the clamp-receiving member (3) when a skier steps into the binding.

19 Claims, 9 Drawing Figures

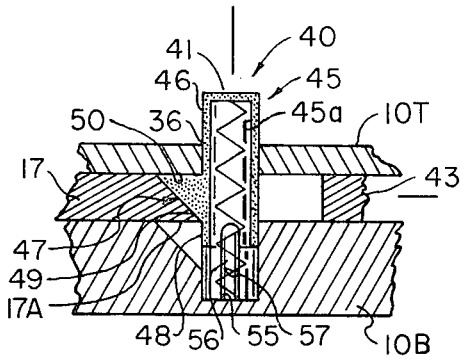
FIG. 3
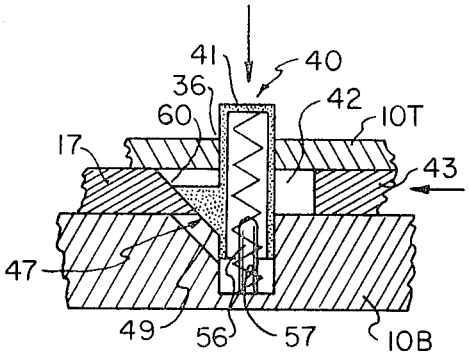
FIG. 4
FIG. 5
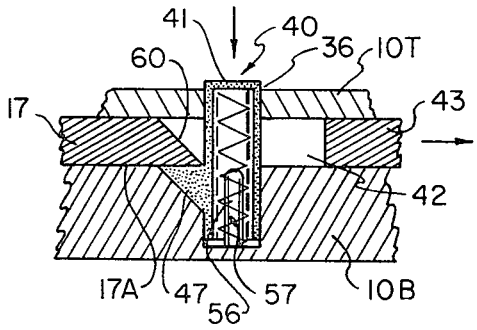
FIG. 6
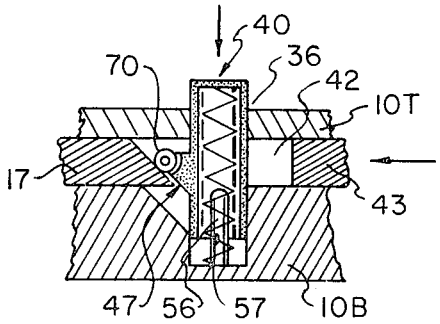
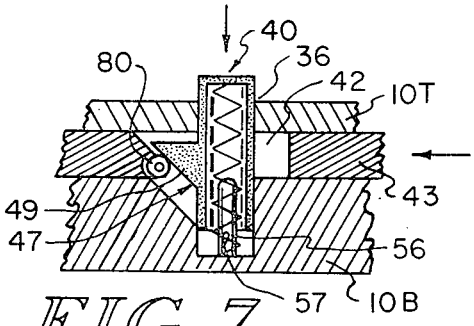
FIG. 7
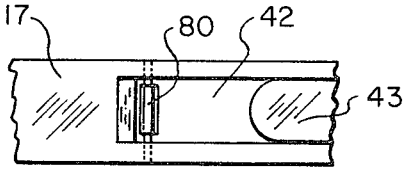
FIG. 8

STEP-IN SKI BINDING

BACKGROUND OF THE INVENTION

The present invention relates to ski bindings in general and in particular to releasable ski bindings having a mechanism by which entry into the binding is effected simply by stepping into the binding. Such bindings are commonly called step-in bindings.

In its simplest form, a releasable binding comprises one or more movable clamping members for releasably engaging one or more clamp-receiving members. The movable clamping members may be on the ski and the clamp-receiving members on the boot; or, alternatively, the location of the members may be reversed. To each of the movable clamping members there is coupled a mechanism, sometimes called a force unit, for applying a clamping force to the member. The mechanism for applying the clamping force to the movable clamping member may take several forms. One of the most common forms is a spring member. The spring member is particularly useful because it is relatively easy to use for applying a resilient clamping force to the movable clamping member. This is important for providing shock absorption and force adjustment. However, other mechanisms, such as electrical, magnetic, etc., may also be used for providing the necessary clamping force. Included among releasable bindings of the type referred to are the familiar toe-heel binding and the more recent side-clamp binding.

In the conventional toe-heel binding a clamping member is provided for clamping the toe and heel portions of a ski boot to a ski. In the conventional side-clamp binding there is provided a movable lateral clamping member for clamping the sides of a ski boot to a ski rearward of the toe and forward of the rear of the heel of the boot.

To facilitate clamping a ski boot to a ski, various step-in mechanisms have been proposed and incorporated in both the toe-heel and side-clamp type ski bindings.

In the conventional toe-heel type ski binding the step-in mechanism which allows a skier to step into a binding comprises a clamping member which is set to receive or is pre-loaded by a clamping force and is generally located at the rear and forms an integral part of the ski boot heel-clamping portion of the toe-heel binding. Typically the heel step-in mechanism is an overcenter type mechanism. In the mechanism a member is provided which extends forwardly of the mechanism to be engaged by the heel of a ski boot. To cock the mechanism and apply the clamping force to the clamping member, the forwardly extending member is moved to a raised position as by a strap, lever member or the like. As the heel of the ski boot is brought to bear thereon, the forwardly extending member is moved overcenter to a lower position wherein the full clamping force is applied to the heel of the ski boot for clamping the ski boot between the heel and toe clamping members. Manual cocking or resetting of the step-in mechanism is typically required prior to each re-entry of the binding.

In the side-clamp type binding, the step-in mechanisms which heretofore have been proposed are located at the heel of the ski boot or in a position to be contacted by the sole of the ski boot generally rearward of the toe and forward of the rear of the heel of the boot.

In the side-clamp type binding in which the step-in mechanism is located at the heel of the ski boot, there is provided, as in the conventional toe-heel type step-in binding, a member which extends forwardly of the mechanism to be engaged by the heel of the ski boot. As in the conventional toe-heel binding, to cock the mechanism and apply the clamping force to the clamping members, the forwardly extending member is moved to a raised position as by a strap, lever member or the like. In one such binding, to manually cock the binding, a force unit comprising a spring member is moved to a position wherein the force of the spring member is removed from the clamping members. When the force of the spring member is removed from the clamping members in this type of binding, the step-in mechanism, which is itself spring-loaded, is moved by its spring to engage a part of the clamping member. After the step-in mechanism engages the clamping member, the force unit is moved to its clamping position. With the force unit moved to its clamping position, the full clamping force of the spring member is restrained by the step-in mechanism from moving the clamping members to their closed or clamping position.

In use, as the heel of the ski boot is brought to bear on the forwardly extending member, the forwardly extending member is moved from its raised position to a lower position. As the forwardly extending member is moved to its lower position, it is disengaged from the clamping member, thereby allowing the clamping member to engage the ski boot or other clamp-receiving means attached to the ski boot with the full clamping force of the spring member.

One of the principal disadvantages of the step-in mechanism of the aforementioned side-clamp type binding is that it is necessary to provide a clearance space in the nature of a cutout in the heel of the boot for the forwardly extending heel-engaging member and parts of the step-in mechanism and force unit rearward thereof. The cutout in the heel portion of the ski boot is required to provide necessary clearance for the parts of this type of step-in mechanism and, in particular, to provide the clearance necessary for the step-in mechanism to automatically reset during involuntary release. Under certain conditions, the binding will cock during a release. A side-clamp type binding of the type described is shown in the German specification Offenlegungsschrift No. 2,649,826.

In the heretofore proposed side-clamp type step-in binding in which the boot-actuated part of the step-in mechanism is located in a position to be contacted by the sole of the ski boot generally rearward of the toe and forward of the rear of the heel of the boot, there is provided a step-in member which is movably mounted in a hole provided therefor in a housing of the binding. In this step-in mechanism the step-in member is provided with a surface for engaging a facing surface on a part of the movable clamping members. To manually cock the binding prior to entry of a ski boot therein, a force unit comprising a spring member is moved to a raised position for removing the clamping force from the clamping members. With the clamping force removed from the clamping members, the step-in member, which is itself spring-loaded, is moved to a raised position wherein the engaging surface on the step-in member engages the facing surface on the clamping members. Thereafter, as the force unit is moved to its clamping position, the full force of the force unit is brought to bear on the step-in member. The binding at this point is prepared for entry.

To enter the binding, a skier places his or her ski boot in skiing position over the step-in member and, pressing down, moves the step-in member downwardly into the housing. As the step-in member is moved downwardly into the housing, the step-in member disengages from the clamping members, allowing the clamping members to engage the ski boot or other clamp-receiving means with the full clamping force of the force unit.

It is also possible to cock or reset the binding during an involuntary release. This occurs when, during an involuntary release, the clamping members open against the force of the spring member and allow the step-in member to move to its cocked position relative to the housing under the force of its spring member. In either case, when cocked, the full clamping force of the force unit is brought to bear on the step-in member. A step-in binding of this type is described in U.S. Pat. No. 4,063,752, assigned to the applicant of the present application.

In considering the known side-clamp type bindings, with step-in mechanisms, it is seen that both of the prior known type bindings have the disadvantage of having the full clamping force of the force unit applied to the step-in member for a substantial period of time when the binding is cocked. This condition imposes severe mechanical requirements on the various parts of the binding and, in particular, on the mechanical structure of the step-in member and facing surface of the clamping members. The previously described side-clamp bindings with the step-in member located at the heel of the ski boot further suffer from the disadvantage of being more complicated structurally and requiring specially made ski boots having cutouts in the heel portion of the sole thereof for providing clearance for parts of the binding mechanism. In comparison, the side-clamp type binding with the step-in member located in use rearward of the toe and forward of the rear of the heel has a simpler mechanical structure and does not require special ski boots. Also, the latter binding achieves its objectives without interfering with the movement of the ski boot relative to a ski in any direction during shock-absorbing maneuvers or release.

SUMMARY OF THE INVENTION

In view of the foregoing, a principal object of the present invention is a releasable, step-in ski binding with means for cocking the binding and thereafter closing the binding using the pressure of a ski boot as the boot is inserted therein.

In accordance with the above object there is provided a ski binding having a housing. Mounted in the housing there is provided a pair of movable clamping members having an open position for receiving a clamp-receiving member and a closed position for clamping the clamp-receiving member and a movable step-in member having a part thereof extendable beyond the surface of the housing for opening said clamp-receiving member as the extendable part of the movable step-in member is pressed toward the housing.

As a part of the movable step-in member there is provided a surface forming a clamp-opening surface which coacts with a facing surface on a part of the clamping members for providing the opening of the clamping members as the step-in member is moved relative thereto.

In another embodiment, a movable bearing member is located between the clamping members and the movable step-in member for reducing friction between the two parts.

In still another embodiment, the movable clamping members and the clamp-receiving member comprise separable parts; one part comprising a pair of lateral edges terminated by spaced tip members and the other part comprising protuberances which overlay the lateral edges and the tip members when the clamping member is clamping the clamp-receiving member. In each of the protuberances, a groove is provided for receiving at least one of the tip members as the tip member is moved past the protuberance as a ski boot is entered into the binding. The groove is provided for reducing the distance the movable clamping members would otherwise be required to move in the absence of the groove when the tip member is moved past the protuberance.

A feature of the present invention is that the clamping members and the movable step-in member each comprise facing surfaces at least one of which is inclined for moving the movable clamping members as the movable step-in member is moved relative thereto.

With the movable step-in member in its raised position, the movable clamping members, in the absence of a ski boot clamped therebetween, are moved to their maximum clamping position under the force of a force unit. At this position of the clamping members, the clamping force applied by the force unit on the clamping members, which is typically provided by a spring under compression, is at a minimum. This is because the spring is substantially fully extended or decompressed. To enter the binding, a ski boot is brought to bear on the top of the step-in member. As the step-in member is pressed by the ski boot, the step-in member is moved downwardly into the housing. As the step-in member is moved downwardly into the housing, the facing surfaces of the step-in member and the movable clamping members engage. Continued pressure on the step-in member causes the step-in member to move the movable clamping members against the force of the spring member in the force unit. As the movable clamping members are moved against the force of the spring member in the force unit, the movable clamping members are moved toward their open position. As the movable clamping members are moved toward their open position, the clamp-receiving member is moved into position to be clamped by the movable clamping members. Continued movement of the step-in member disengages the clamping members therefrom, allowing the clamping members to clamp the clamp-receiving member in releasable engagement. As will be apparent, in the embodiment incorporating the groove, the distance the movable clamping members are required to move for receiving the clamp-receiving member as the ski boot pressure is brought to bear on the step-in member is reduced, thereby reducing the force required for entry into the binding.

BRIEF DESCRIPTION OF THE DRAWINGS

The above and other objects, features and advantages of the present invention will become apparent from the following detailed description of the accompanying drawings in which:

FIG. 3 is an enlarged partial cross-sectional view of a step-in member according to the present invention taken along the lines 3—3 of FIG. 1 with the step-in member in its raised or pre-cocked position.

FIG. 4 is a view of the step-in member of FIG. 3 showing the position of the step-in member and facing parts when the step-in member is moved from its pre-cocked to its nearly cocked position and has moved the movable clamping members to their nearly maximum open position.

FIG. 5 is a view of the step-in member of FIGS. 3 and 4 showing the position of the step-in member when the clamping members are released for clamping the clamp-receiving member.

FIGS. 6 and 7 are partial cross-sectional views of alternative embodiments of the present invention, showing a bearing member for reducing friction between the step-in member and the movable clamping members.

FIG. 8 is a partial plan view of the connecting member of FIG. 7 s showing the relative position of the bearing member therein.

DETAILED DESCRIPTION OF THE DRAWINGS

Figure 1:
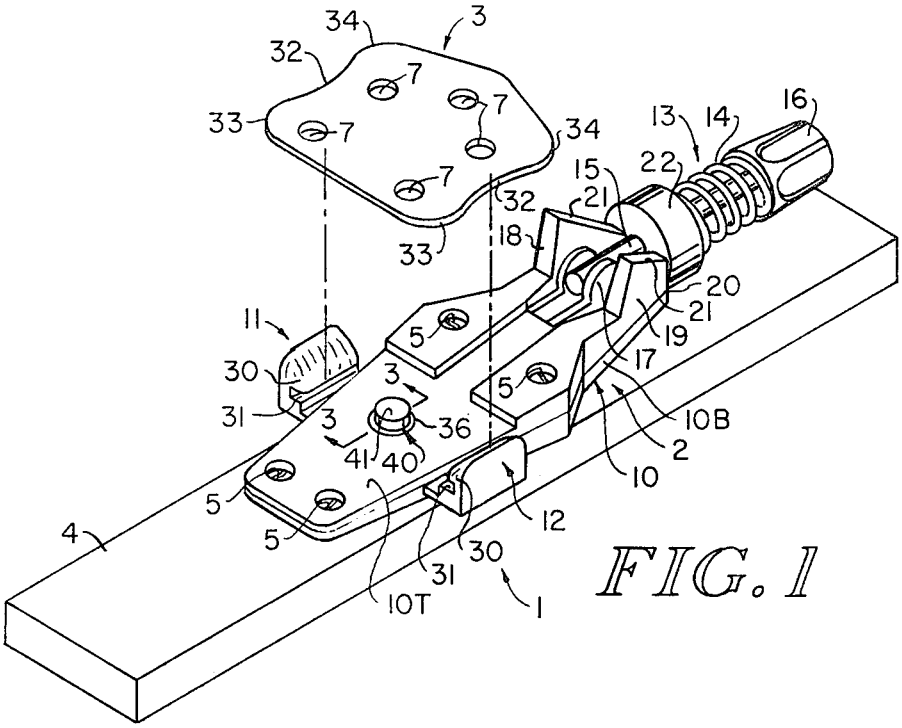
FIG. 1 is a perspective view of an embodiment of the present invention.

Referring to FIG. 1, there is provided in accordance with the present invention, a releasable, step-in ski binding designated generally as 1. In the binding 1, there is provided a movable clamping mechanism designated generally as 2 and a clamp-receiving member or plate designated generally as 3. In a typical embodiment, the mechanism 2 is mounted on the upper surface of a ski 4 as by a plurality of screws 5. The clamp-receiving member or plate 3 is mounted to the sole of a ski boot as by a plurality of screws mounted in a plurality of screw holes 7. Alternatively, the mechanism 2, suitably modified, could be mounted in the sole of the ski boot and the plate 3, suitably modified, could be mounted on the upper surface of the ski 4, as taught in applicant's U.S. Pat. No. 3,606,370.

In the mechanism 2 there is provided a housing 10 comprising an upper or top housing member 10T and a lower or bottom housing member 10B. In the housing 10, between member 10T and 10B, there is pivotably mounted a pair of movable clamping members 11 and 12. The clamping members 11 and 12 are mounted for lateral movement relative to the housing member 10 for releasably clamping the plate 3 therebetween. It is understood that, in lieu of plate 3, the ski boot could be suitably modified so as to releasably receive the clamping members 11 and 12 directly.

Figure 2:
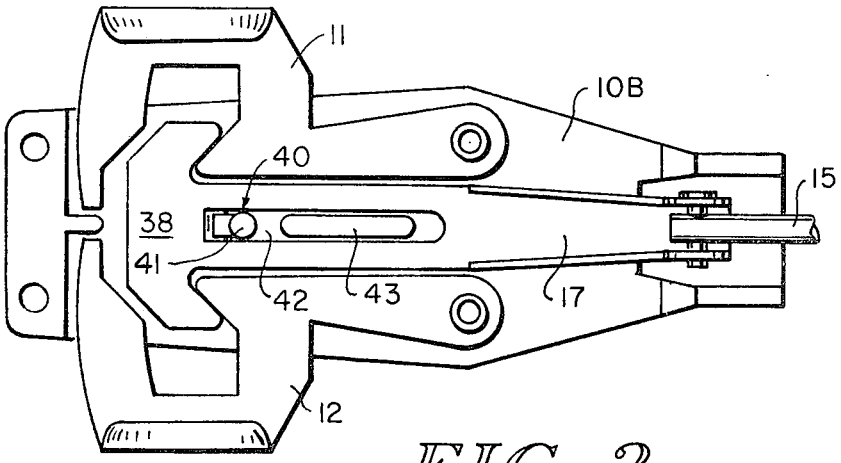
FIG. 2 is a plan view of the clamping members and T-shaped connecting member of the embodiment of FIG. 1.

At the rear of the mechanism 2, there is provided a force unit designated generally as 13. In the force unit 13, there is provided a spring 14. Coaxial with the spring 14, there is provided a rod 15. At its rear end the rod 15 is provided with threads for threadably receiving a manually rotatable nut member 16. At its forward end, the rod 15 is pivotably connected to a T-shaped connecting member 17. As will be described below with respect to FIG. 2, connecting member 17 couples the force unit 13 to the movable clamping members 11 and 12. For that reason, the member 17 is sometimes referred to herein as a clamping member.

At the rear end of the housing 10, an opposite sides of the forward end of the rod 15, there is provided a pair of spaced, upstanding wall members 18 and 19. Each of the members 18 and 19 is provided with a rear ramp 20 and an upper ramp 21. Located between spring 14 and the rear ramp 20, and coaxial with the rod 15, there is provided a washer 22.

In each of the clamping members 11 and 12, there is provided a protuberance 30. Below the protuberance 30, there is provided a shoulder 31. Between the protuberance 30 and the shoulder 31, there is provided a space for receiving the plate 3.

The plate 3 is provided with a pair of beveled curved lateral edges 32. Each of the edges 32 is terminated by a forward tip member 33 and a rearward tip member 34. When the plate 3 is engaged by the clamping members 11 and 12, the protuberance 30 overlays the lateral edges 32 of the plate 3 and the forward and rearward tip members 33 and 34, extending from the ends thereof.

Located generally along the center line of the housing 10 in a hole 36 provided therefor in the top housing member 10T, there is provided a step-in member 40. The step-in member 40 is provided with an upper surface 41 which is extendable above the exterior surface of the top housing member 10T, to be contacted by a ski boot for opening and closing the clamping members 11 and 12 during an entry of the ski boot therebetween. While shown between the clamping members 11 and 12, it is understood that this position of the step-in member 40 is preferred only because it tends to require a skier to place his or her ski boot in skiing position when entering the binding. In other embodiments, the step-in member 40 could be located at other positions so long as it is able to control the opening and closing of the clamping members 11 and 12, as will be described.

As thus far described, with the exception of the presence and operation of the step-in member 40, which will be further described with respect to FIGS. 2–5, the ski binding 1 is functionally identical to the ski binding described in applicant's U.S. Pat. No. 3,606,370.

Referring to FIGS. 2–5, there is shown, with the upper housing member 10T omitted for clarity, a partial top plan view of the movable clamping members 11 and 12, connecting member 17 and rod 15. At its left end, the connecting member 17 is provided with a T-shaped section 38 having engaging surfaces for slidably engaging surfaces provided therefor in each of the movable clamping members 11 and 12 in the manner described in applicant's U.S. Pat. No. 3,606,370. In the center of the connecting member 17 there is provided an elongated slot 42. The slot 42 is provided for receiving a web 43. The web 43 is a rigid member which extends upwardly from the lower housing member 10B for guiding the longitudinal movement of the connecting member 17. Forward of the web 43 there is located in a space provided therefor in the slot 42, the step-in member 40, described above with respect to FIG. 1 and which will be described in more detail below with respect to FIGS. 3–5.

Referring to FIGS. 3, 4 and 5, there is provided in the step-in member 40 a generally elongated main body portion designated generally as 45. In the main body portion 45 there is provided an interior spring-receiving cavity 45A and an extendable portion 46 which, when fully raised, is extendable above the upper surface of the upper housing member 10T for placing the surface 41 on the top thereof in a position to be contacted by a ski boot for entry into the binding. At its lower end the main body portion 45 is provided with an outwardly, forwardly extending member 47 and an interior end 48. The member 47 comprises a clamp-opening surface 49 which is inclined forwardly and outwardly from the interior end 48 of the member 45. Extending inwardly from the forward upper edge of the inclined surface 49 there is provided a clamp-closing surface 50. The surface 50 extends inwardly and generally perpendicular to the longitudinal axis of the member 40.

In the bottom housing member 10B there is provided a step-in member well 55. The step-in member well 55 is provided for freely receiving the lower portion, including the outwardly extending member 47 of the body member 45 of the step-in member 40. Extending upwardly from the bottom of the well 55 there is provided a spring pin guide 56. The spring pin guide 56 is provided for aligning and guiding a spring 57. The spring 57 is provided and inserted in the cavity 45A provided therefor in the main body member 45 of the step-in member 40 for pushing the step-in member 40 out of the well and to its outwardmost position relative to the upper housing member 10T when, as will be described, the connecting member 17 is moved to its most forward position.

Referring to FIGS. 4 and 5, it is more clearly shown that the surface 49 of the inclined member 47 coacts with a corresponding inclined surface 60 at the forward edge of the slot 42 in the connecting member 17.

In use, to manually set the binding 1 for entry of a ski boot therein, the force unit 13 is pivoted from a horizontal position, as shown in FIG. 1, to a vertical position. With the force unit 13 in a vertical position, the force of the spring member 14 is removed from the connecting member 17. With the force of the spring member 14 removed from the connecting member 17, the connecting member 17 is free to move forwardly, allowing the clamping members 11 and 12 to move outwardly. With the connecting member 17 moved to its forward position and the clamping members 11 and 12 moved to their outermost position, the step-in member 40 is free to be moved by its spring 57 to its outermost or pre-cocked position, as shown in FIG. 3. With the step-in member 40 moved to its outermost or pre-cocked position, as shown in FIG. 3, the force unit 13 is then lowered to its horizontal position, as shown in FIG. 1. The lowering of the force unit 13 to its horizontal position, as shown in FIG. 1, causes the connecting member 17 to be pulled rearwardly by the rod 15 and spring 14. The pulling of the connecting member 17 rearwardly by the rod 15 causes the connecting member to engage the clamping members 11 and 12, causing the clamping members to be pulled inwardly.

The distance the member 17 is moved rearwardly is a function of the position of the threaded nut member 16 at the rear end of the force unit 13. If the nut member 16 is provided with a right-hand thread, a clockwise rotation of the nut 16 will cause the rod 15 to be drawn rearwardly together with the connecting member 17. Once the rod 15 and connecting member 17 are moved rearwardly as far as the mechanical structure of the binding will permit, continued clockwise rotation of the nut member 16 will begin compressing the spring 14, applying a clamping force to the movable clamping members 11 and 12 through the connecting member 17. If, at this point, an attempt is made to separate the clamping members 11 and 12, the effort will be met by an opposing force, the magnitude of which corresponds to the strength of the spring 14. Conversely, to reduce the force necessary to separate the clamping members 11 and 12, the nut member 16 is rotated counterclockwise to pemit a decompression of the spring 14.

With the step-in member 40 in its outwardmost or pre-cocked position, as shown in FIG. 3, the binding 1 is ready for entry of a boot therein.

As a skier places his ski boot in skiing position, and presses against the top surface 41 of the step-in member 40, the step-in member 40 is caused to move downwardly into the hole 36 provided therefor against the force of its spring member 57. As the step-in member 40 moves downwardly into the hole 36 provided therefor in the upper housing member 10T, the clamp-opening surface 49 of the member 47 of the step-in member 40 engages the inclined facing surface 60 at the forward end of the slot 42 in the connecting member 17. As the surface 49 engages the surface 60, continued pressure on and movement of the step-in member 40 relative to the surface 60 on the connecting member 17, causes the connecting member 17 to move forwardly, as shown in FIG. 4. As the connecting member 17 is caused to move forwardly, the movable clamping members 11 and 12 are allowed to move outwardly for receiving the plate member 3.

With continued pressure on the step-in member 40, the step-in member 40 is caused to move still lower into the housing 10T until the upper surface 41 thereof is substantially flush with the upper surface of the housing member 10T. At this point, the plate 3 is between the clamping members 11 and 12 and the lower surface 17A of the connecting member 17 clears the upper forward edge of the member 47 of the step-in member 40.

As shown in FIG. 5, when the lower surface 17A of the connecting member 17 clears the upper forward edge of the member 47, the connecting member 17 is free to move rearwardly under the force of the spring 14, pulling the clamping members 11 and 12 together for releasably engaging the plate 3. With the plate 3 releasably engaged between the clamping members 11 and 12, the clamping force is determined by the amount the spring 14 is compressed. As previously described, to reduce the clamping force to a minimum with the plate 3 releasably engaged between the clamping members 11 and 12, the nut 16 is rotated counterclockwise. To increase the clamping force with the plate 3 releasably engaged by the clamping members 11 and 12, the nut 16 is rotated clockwise. Regardless of the magnitude of the initial clamping force applied for clamping the plate 3, it will be appreciated that, as the plate 3 is released from between the clamping members 11 and 12 and the clamping members 11 and 12 are forced apart during an involuntary release, the restoring force increases as a function of the spring constant. In any event, with the plate 3 releasably engaged by the clamping members 11 and 12, the binding 1 functions in the manner described in applicant's prior U.S. Pat. No. 3,606,370.

Referring to FIG. 6, there is provided in an alternative embodiment of the present invention a rotatable bearing member 70. The bearing member 70 is mounted on the leading edge of the member 47 of the step-in member 40. It is a roller-type bearing or functionally similar member and extends from the member 47 for engaging the inclined surface 60 at the forward end of the slot 42 in the connecting member 17 as the step-in member is moved relative thereto.

In use, as the bearing member 70 is moved relative to the surface 60, the member 70 rotates. The rotation of the member 70 reduces the friction between the step-in member 40 and the connecting member 17.

Referring to FIGS. 7 and 8, there is provided in another embodiment of the present invention at the lower rear edge of the forward end of the slot 42 in the connecting member 17 a bearing member 80. The bearing member 80 is provided for rotatably engaging the inclined surface 49 of the member 47. Because the bearing member 80 rotates as the surface 49 is moved relative thereto, friction between the step-in member 40 and the connecting member 17 is considerably reduced as the step-in member 40 is moved relative to the connecting member 17.

Figure 9:
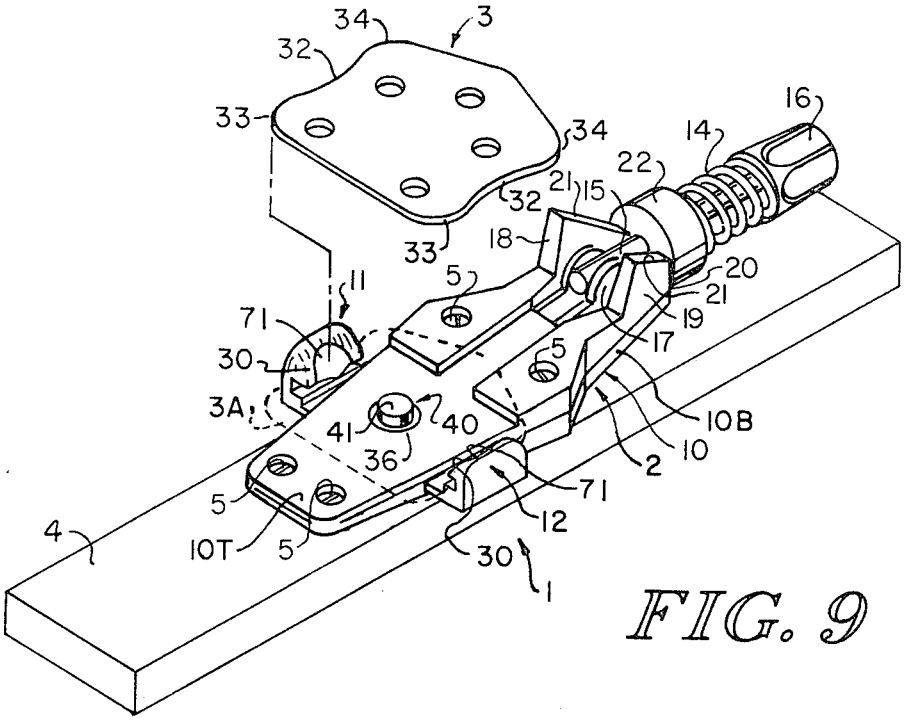
FIG. 9 is a perspective view of a binding according to the present invention wherein the movable clamping members and the clamp-receiving member comprise a protuberance in which there is provided a groove for reducing the distance the movable clamping members would otherwise, in the absence of said groove, be required to be moved when the tip member of the clamp-receiving member is moved past the protuberance.

Referring to FIG. 9, there is provided in still another embodiment of the present invention in the protuberance 30 of each of the movable clamping members 11 and 12, a vertically extending groove 71. The groove 71 comprises a generally elongated, concave surface, the midline of which slopes downwardly, inwardly to the center of and forwardly or rearwardly relative to a ski on which the binding 1 is mounted. It is provided generally in the center of the protuberance 30 of each of the movable clamping members 11 and 12 for receiving the tip members 33 or 34 of the boot-mounted clamp-receiving plate 3. For convenience, usually it is the forward tip members which are used.

In use, as a skier steps into the binding 1, the forward tip members 33 are pressed into the grooves 71. As the boot contacts the upper surface 41 of the step-in member 40, the step-in member 40 causes the clamping members 11 and 12 to move outwardly. Because of the groove 71, the amount of the force required for moving the clamping members 11 and 12 and the distance the clamping members 11 and 12 are required to be moved outwardly when the plate 3 is inserted between the clamping members is reduced. When the lateral edges 32 between the forward and rearward tip members 33 and 34 of the plate 3 move below the lower surface of the protuberance 30 of the clamping members 11 and 12, the clamping members which are coupled to the spring 14 are caused to move inwardly by the spring 14. As the clamping members 11 and 12 press against the lateral edges 32 of the plate member 3, the plate member 3, due to its inwardly curved lateral edges 32, becomes centered relative to the clamping members 11 and 12, as shown in phantom lines designated 3A. With the plate member 3 centered relative to the clamping members 11 and 12, the protuberances 30 overlay substantially all of the lateral edges 32 and at least a portion of the tip members 33 and 34. With the plate 3 centered between the clamping members 11 and 12, the binding 1 operates and releases during fall conditions in a conventional manner, as described above in applicant's prior U.S. Pat. No. 3,606,370.

In accordance with applicant'invention, a number of embodiments of the invention are described above. It is understood, however, that still other changes and modifications to the structure of the embodiments of the invention described herein may be made without departing from the spirit and scope of the present invention. For example, while a spring member is described for providing the necessary clamping force, it is contemplated that electrical and magnetic mechanisms, as well as combinations of other suitable mechanisms may be employed for the purpose of providing the necessary clamping force. Likewise, the T-shaped connecting member 17 and clamping members 11 and 12 could be replaced or modified to operate in a somewhat different fashion. Also, the position of the step-in member 40 may be changed according to the requirements of a particular application. Whatever the changes, it is clear that a principal advantage of the present invention lies in its simplicity. Accordingly, it is intended that the embodiments described and the modifications suggested are merely for purposes of illustrating the present invention and that the scope of the present invention should be determined, not solely by reference to the embodiments described, but rather by reference to the claims and their equivalents hereinafter provided.

What is claimed is:

1. A step-in ski binding for securing a ski boot to a ski rearward of the toe and forward of the rear of the heel of the ski boot comprising:

an engaging member having an opened condition for disengaging the ski boot and the ski and a closed condition for engaging the ski boot and the ski;

a step-in member changeable in response to an entry of said ski boot into said binding betwen first, second and third separate and distinct conditions, said first and said third conditions corresponding to said closed condition of said engaging member and said second condition corresponding to said open condition of said engaging member; and means coupling said step-in member and said engaging member for changing said engaging member from said closed condition to said open condition when said step-in member is changed from its first to its second condition, and for changing said engaging member from said open condition to said closed condition when said step-in member is changed from said second to said third condition.

2. A ski binding according to claim 1 comprising a housing and wherein said engaging member comprises a movable clamping member having an open position for receiving a clamp-receiving member and a closed position for clamping the clamp-receiving member, wherein said opened condition comprises said opened position and said closed condition comprises said closed position; and said step-in member comprises a movable step-in member mounted in said housing having a part thereof extendable beyond the surface of the housing for opening said clamping member as said extendable part of said movable step-in member is pressed toward said housing.

3. A ski binding according to claim 2 wherein said movable step-in member comprises a surface forming a clamp-opening surface which coacts with a facing surface on a part of said clamping member for providing said opening of said clamping member.

4. A ski binding according to claim 3 wherein said clamp-opening surface comprises an engaging surface for engaging said facing surface on said clamping member as said engaging surface is moved relative thereto and comprising a clamp-closing surface which forms a clearance space for receiving said clamping member as said clamping member moves from its open position to its closed position in reponse to a further force applied to said extendable part of said step-in member following a movement of said clamping member to its open position.

5. A ski binding according to claim 3 wherein said movable step-in member is provided with an end in the interior of said housing, said clamp-opening surface is inclined outwardly from said interior end for engaging said facing surface on said clamping member and comprising a clamp-closing surface which extends generally perpendicular to the upper edge of said inclined surface.

6. A ski binding according to claim 5 comprising a spring member for moving said movable member outwardly relative to said housing.

7. A ski binding according to claim 2 comprising a movable bearing member located between said clamping member and said movable step-in member for facilitating the movement of said movable step-in member and said opening of said clamping member.

8. A ski binding according to claim 7 wherein said movable bearing member is located on a part of said clamping member and said movable step-in member is located adjacent to said bearing member for contacting said bearing member as said step-in member is pressed toward said housing.

9. A ski binding according to claim 8 wherein said bearing member is a roller-type bearing member.

10. A ski binding according to claim 2 wherein said clamping member and said movable step-in member each comprises facing surfaces at least one of which is inclined.

11. A ski binding according to claim 10 comprising a movable bearing member movably mounted opposite said inclined surface for providing a low friction interface with said inclined surface as said inclined surface is moved relative thereto.

12. A ski binding according to claim 11 wherein said movable bearing member is a roller-type bearing member.

13. A ski binding according to claim 2 wherein said movable step-in member is movable relative to said clamping member and said movable clamping member and said movable step-in member comprise engaging surfaces at least one of which is inclined for moving the movable clamping member as said movable step-in member is moved relative thereto.

14. A ski binding according to claim 13 comprising a movable bearing member and wherein said inclined surface engages said bearing member as said movable step-in member is moved relative thereto for providing said moving of said movable clamping member.

15. A ski binding according to claim 2 wherein said movable clamping member and said clamp-receiving member comprise a pair of spaced tip members and a protuberance which overlays said tip members when said clamping member is clamping said clamp-receiving member; and a groove disposed in said protuberance for receiving at least one of said tip members as said tip member is moved past said protuberance, said groove being provided for reducing the distance said movable clamping member would otherwise, in the absence of said groove, be required to be moved when said tip member is moved past said protuberance.

16. A ski binding according to claim 15 wherein said clamping member below said protuberance and said clamp-receiving member between said spaced tip members are each provided with a contour which causes said clamp-receiving member to become centered relative to said clamping member when said clamp-receiving member is pressed past said protuberance.

17. A ski binding according to claim 16 wherein said contour of said clamp-receiving member between said tip members is generally V-shaped.

18. A ski binding according to claim 15 wherein said groove in said protuberance comprises a generally elongated concave surface the midline of which slopes downwardly, inwardly and forwardly relative to a ski on which the binding is mounted.

19. A ski binding according to claim 2 wherein said clamping member comprises a step-in member engaging surface, and said step-in member comprises:

a first surface which is inclined outwardly from the bottom thereof at an angle to the longitudinal axis thereof for engaging said step-in member engaging surface of said clamping member; and a second surface which extends inwardly at an angle from the upper edge of said first surface for allowing said step-in member engaging surface of said clamping member to move inwardly relative thereto.

* * * * *